US010548390B2

(12) United States Patent
Marui

(10) Patent No.: US 10,548,390 B2
(45) Date of Patent: Feb. 4, 2020

(54) RESERVOIR

(71) Applicant: Shinji Marui, Kobe (JP)

(72) Inventor: Shinji Marui, Kobe (JP)

( * ) Notice: Subject to any disclaimer, the term of this patent is extended or adjusted under 35 U.S.C. 154(b) by 8 days.

(21) Appl. No.: 15/660,042

(22) Filed: Jul. 26, 2017

(65) Prior Publication Data

US 2017/0318942 A1 Nov. 9, 2017

Related U.S. Application Data

(63) Continuation-in-part of application No. 14/919,392, filed on Oct. 21, 2015.

(30) Foreign Application Priority Data

Oct. 22, 2014 (JP) ..... 2014-215070

(51) Int. Cl.

| | |
|---|---|
| ***A45F 3/14*** | (2006.01) |
| ***A45F 3/16*** | (2006.01) |
| ***A45F 3/04*** | (2006.01) |
| ***A45F 3/20*** | (2006.01) |
| ***A45F 3/18*** | (2006.01) |

(52) U.S. Cl.

CPC ..... *A45F 3/14* (2013.01); *A45F 3/04* (2013.01); *A45F 3/16* (2013.01); *A45F 3/18* (2013.01); *A45F 3/20* (2013.01); *A45F 2003/146* (2013.01); *A45F 2003/166* (2013.01)

(58) Field of Classification Search

CPC ..... A45F 3/14; A45F 2003/205; A45F 3/20; A45F 2003/166; A45F 3/16; A45F 2003/006; A45F 2003/003; A45F 3/12; A45F 2003/002; A45F 13/02; A45F 3/04; A45F 3/18; A63B 21/0602; A63B 2225/682; A63B 21/065; B65D 75/5872; B65D 75/5877; B65D 33/00; B62B 2202/023; Y10S 383/901; A45C 13/02

USPC ..... 224/650, 148.2; 383/901, 7

See application file for complete search history.

(56) References Cited

U.S. PATENT DOCUMENTS

| | | | | |
|---|---|---|---|---|
| 4,139,130 A | | 2/1979 | Glusker et al. | |
| 4,526,298 A | * | 7/1985 | Boxer | A45F 3/16 222/130 |
| 4,836,416 A | | 6/1989 | Shalgi et al. | |
| 5,023,119 A | * | 6/1991 | Yamakoshi | A61J 1/10 264/232 |
| 5,230,566 A | | 7/1993 | Jackson et al. | |

(Continued)

OTHER PUBLICATIONS

Office Action dated Sep. 20, 2017 from related U.S. Appl. No. 14/919,392.

(Continued)

*Primary Examiner* — Nathan J Newhouse
*Assistant Examiner* — Matthew T Theis
(74) *Attorney, Agent, or Firm* — Innovation Capital Law Group, LLP; Vic Lin

(57) ABSTRACT

A wearable fluid reservoir configured to contain liquids includes a swinging suppressing mechanism to inhibit horizontal and vertical swinging of a reservoir main body in relation to a hydration pack in which the reservoir main body is inserted. The pack includes a connecting mechanism that mates with the swinging suppressing mechanism to form a detachable, yet secure fit between the reservoir and the pack. A sipping tube is coupled to the reservoir main body.

15 Claims, 10 Drawing Sheets

(56) References Cited

U.S. PATENT DOCUMENTS

| | | | | |
|---|---|---|---|---|
| 5,425,528 | A * | 6/1995 | Rains | A61M 5/204 251/149.1 |
| 5,853,247 | A * | 12/1998 | Shroyer | B01L 3/505 383/95 |
| 5,864,880 | A * | 2/1999 | Adam | A41D 1/04 2/108 |
| 2004/0128747 | A1* | 7/2004 | Bumbarger | A41D 13/0053 2/458 |
| 2007/0012733 | A1 | 1/2007 | Horito et al. | |
| 2007/0163689 | A1* | 7/2007 | Pace | A45C 3/08 150/105 |
| 2011/0101050 | A1* | 5/2011 | Parazynski | A45F 3/04 224/148.2 |

OTHER PUBLICATIONS

Final Office Action dated May 14, 2018 from U.S. Appl. No. 14/919,392.

* cited by examiner

RESERVOIR

BACKGROUND OF THE INVENTION

1. Field of the Invention

The invention relates generally to wearable portable liquid containers and hydration backpacks.

2. Description of Prior Art and Related Information

Conventional hydration backpacks typically include a pouch for holding liquid that is inserted into a backpack worn by a user. The pouch may be loosely on a hook within the backpack. The lack of a secure attachment between the pouch and the backpack causes the pouch to swing vertically and horizontally within the backpack, particularly as the volume of the pouch shrinks due to consumption of the fluids therein.

As the fluid within the pouch is consumed and the volume of the pouch diminishes, a gap is created between the reduced pouch and the backpack. Such gaps can lead to excessive swinging of the pouch within the backpack particularly as the user engages in intense shifting movements, e.g., making turns on a bicycle.

Examples of prior art hydration backpacks include:

http://www.e-mot.co.jp/platypus/hydration-systems.asp

SUMMARY OF THE INVENTION

In accordance with the present invention, structures and associated methods are disclosed which address these needs and overcome the deficiencies of the prior art.

The object of the present invention is to provide a portable wearable reservoir that suppresses or inhibits swinging movements of a reservoir within a bag, such as a backpack. The reservoir is preferably detachable from the backpack. While the reservoir is preferably removable, a secure attachment is made between the reservoir and the backpack according to the invention in order to inhibit swinging movements of the reservoir within the back.

The meaning of the term reservoir used in the present specification generally refers to a container that can carry liquids such as water.

Preferred embodiments of swinging suppressing mechanisms are provided to removably secure a reservoir to the backpack in which the reservoir is housed. The swinging suppressing mechanism reduces the burden on the user's body by inhibiting loose movement of the reservoir within the backpack.

The swinging suppressing mechanism may be attached in a single location or in multiple locations. Even when attached to the backpack at a single location, the swinging suppressing mechanism provides a fixed position between the reservoir and the backpack so as to suppress loose or rotating movements of the reservoir relative to the backpack.

In one embodiment, the swinging suppressing mechanism inhibits horizontal or lateral swinging movements through the use of friction in the contact between the outer surface of the reservoir and the inner surface of the backpack. The preferred mechanism may comprise a material having a large coefficient of friction.

In another embodiment, the swinging suppressing mechanism may comprise a suction cup coupled to an outer surface of the reservoir. The swinging suppressing mechanism may also comprise a protrusion that mates with an opening formed in the backpack. The swinging suppressing mechanism may comprise corrugated sheets having horizontally and vertically oriented waves that mate with similarly formed corrugated surfaces within the backpack. The swinging suppressing mechanism may also comprise hooks or a strut extending vertically through the reservoir.

The material of the reservoir may comprise a bag composed of an elastic material or a hard material. Moreover, at least one swinging suppressing mechanism may be deployed in the region of the mechanism which closes the port used to seal the liquid within the reservoir. Alternatively, an integrated form with the main body unit of the reservoir can be also used.

The reservoir may be mounted on the side of the backpack in contact with the user's back. In addition, a cushion with a matching planar of three-dimensional shape may also be attached on the side of the backpack in contact with the user, providing a more comfortable fit.

A planar or three-dimensional member may also be attached as a reinforcing member in order to maintain the shape of the main body of the reservoir. Where the reservoir comprises a flexible bag, a reinforcing member attached thereto helps maintain the shape of the main body of reservoir regardless of the remaining amount of liquid content therein.

The effect of the preferred reservoirs according to the invention is that any shifting or swinging of the reservoir relative to the backpack will be reduced and minimized even as the user makes any quick or jolting movements.

In summary, a wearable fluid reservoir configured to contain liquids includes a swinging suppressing mechanism to inhibit horizontal and vertical swinging of a reservoir main body in relation to a hydration pack in which the reservoir main body is inserted. The pack includes a connecting mechanism that mates with the swinging suppressing mechanism to form a detachable, yet secure fit between the reservoir and the pack. A sipping tube is coupled to the reservoir main body.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

Figure 1:
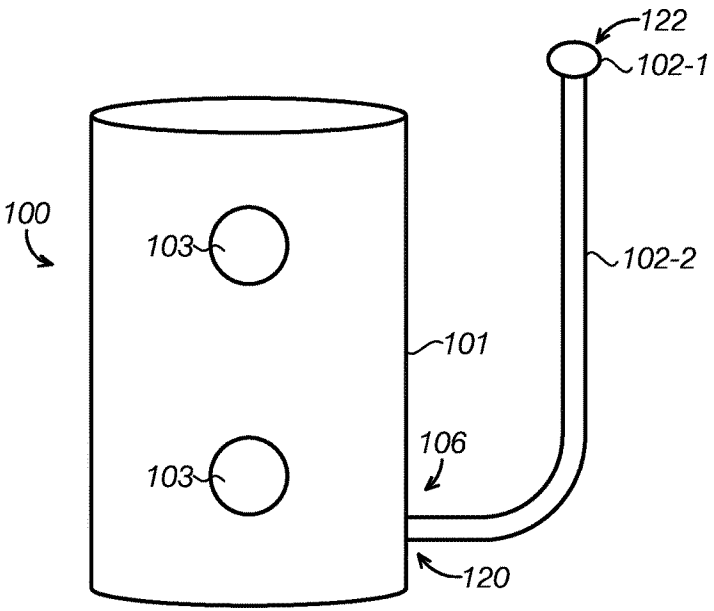
FIG. 1 shows a front view of a first preferred embodiment of a reservoir.

A first preferred embodiment of a wearable fluid reservoir is illustrated in FIG. 1 and designated generally by the reference numeral 100. The portable reservoir 100 comprises a reservoir main body 101 configured to hold liquids. One end portion 120 of a sipping tube 102-2 is coupled to a lower portion 106 of the reservoir main body 101 while an opposite tube portion 122 is in fluid communication with a suction option 102-1. A user can drink liquid from the suction opening 102-1.

Figure 3:
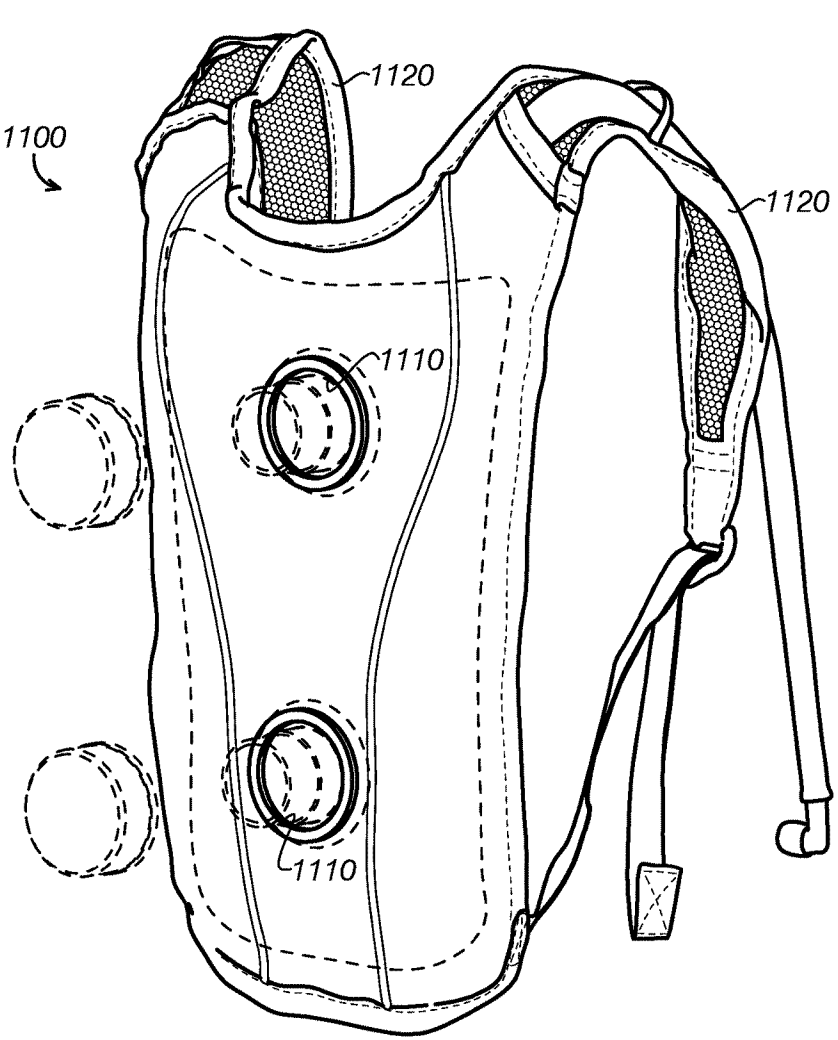
FIG. 3 is a rear view of a preferred hydration backpack configured to hold the first preferred embodiment of the reservoir.

The reservoir 100 includes a preferred swinging suppressing mechanism 103 that inhibits swinging or loose movements of the reservoir 100 in relation to a preferred embodiment of a hydration backpack, or simply pack, 1100 shown in FIG. 3, into which the reservoir 100 is inserted. In the first preferred embodiment shown in FIG. 1, the swinging suppressing mechanism 103 comprises mounting sections, or buttons, 103 arranged vertically in order to fix the reservoir main body 101 to the preferred pack shown in FIG. 3.

In FIG. 3, the preferred backpack 1100 comprises a connecting mechanism 1110 configured to removably mate with the swinging suppressing mechanism 103 of the reservoir 100. The pack 1110 is configured to be worn on a user and comprises a pair of shoulder straps 1120. In this preferred embodiment, the connecting mechanism 1110 comprises two openings 1110 to receive the reservoir buttons 103 in FIG. 1. Thus, the two openings 1110 are exactly positioned and aligned with the two buttons 103 to provide a secure fit. This prevents the reservoir main body 101 from swinging or moving loosely within the backpack 1100, thereby reducing the burden on the user. In particular, the combination of the swinging suppressing mechanism 103 of the reservoir 100 removably coupled to the connecting mechanism 1110 of the pack 1100 inhibits both horizontal and vertical movement of the reservoir 100 with respect to the pack 1100.

Figure 2:
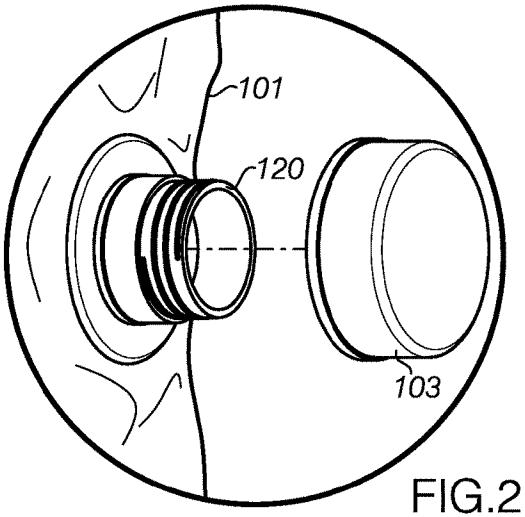
FIG. 2 is close-up perspective view of a preferred swinging suppressing mechanism that also comprises a port for filling a reservoir.

In FIG. 2, the swinging suppressing mechanism 103 may comprise a removable, internally threaded button 103 that can be screwed onto an externally threaded spout 120 through which the reservoir 100 is filled with liquid. In this preferred embodiment where the swinging suppressing mechanism 103 also comprises the port for filling the reservoir 100, the reservoir 100 need not include an additional opening for refilling.

Figure 5:
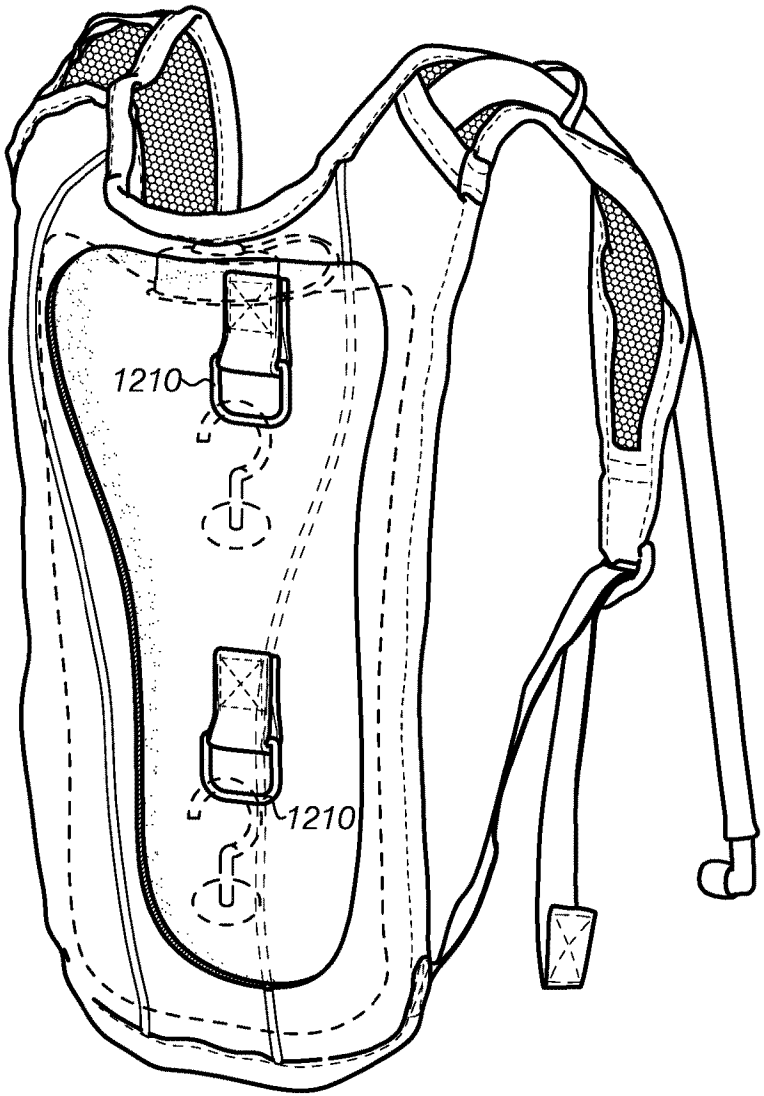
FIG. 5 shows a rear partial cutaway view of an alternative embodiment of a hydration backpack configured to hold the second preferred reservoir.
Figure 4:
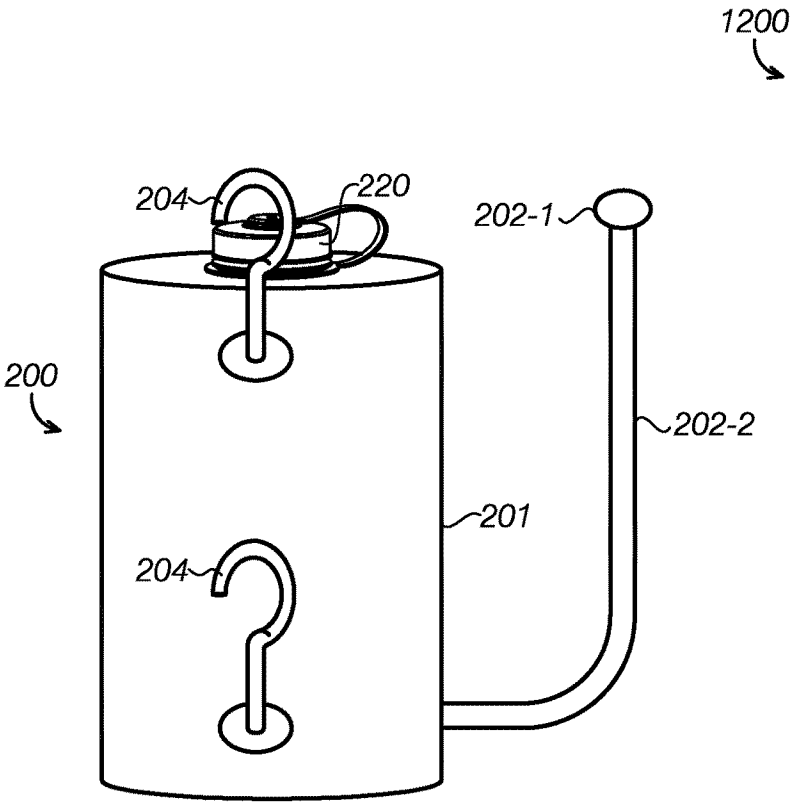
FIG. 4 shows a front perspective view of a second preferred embodiment of a reservoir.

A second preferred embodiment of a reservoir 200 in FIG. 4 is configured to be securely retained within an alternative embodiment of a hydration pack 1200 in FIG. 5. In FIG. 4, the swinging suppressing mechanism 204 comprises one or more hooks 204 that can hook through the connecting mechanism 1210 shown in FIG. 5 which preferably comprises loops 1210 or openings formed in the pack 1200. Since such connectors 204 and the connecting mechanism 1210 form a detachable connection, the reservoir 200 can be manually removed from the pack 1200 when the reservoir 200 is not in use. The material of the reservoir main body 201 may a comprise a material suitable for a soft bag that does not expand or contract even when deformed. The reservoir main body 201 may also be composed of a rigid material characterized by hardness. The reservoir 200 also comprises a removable cap 220 covering an opening through which the reservoir 200 may be filled with liquid.

Figure 7:
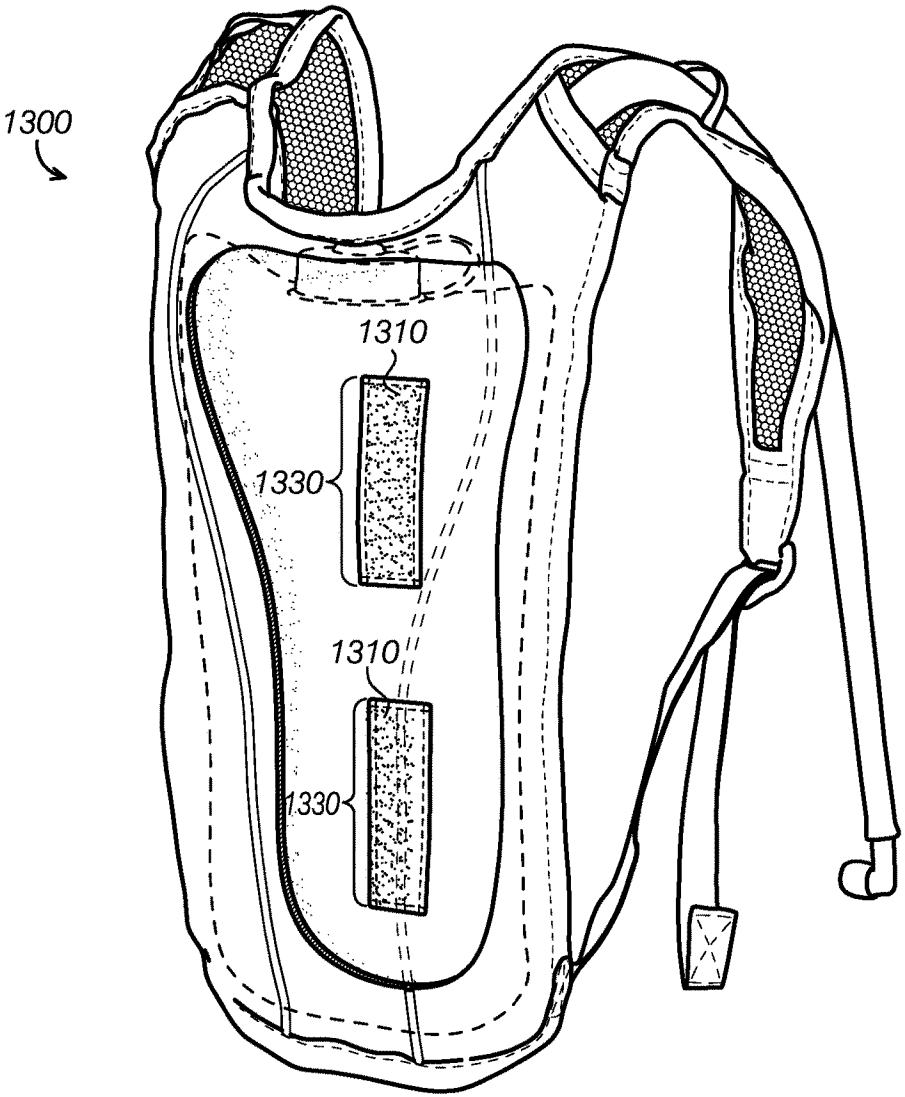
FIG. 7 shows a rear partial cutaway perspective view of an alternative embodiment of a hydration backpack configured to hold the third preferred reservoir.
Figure 6:
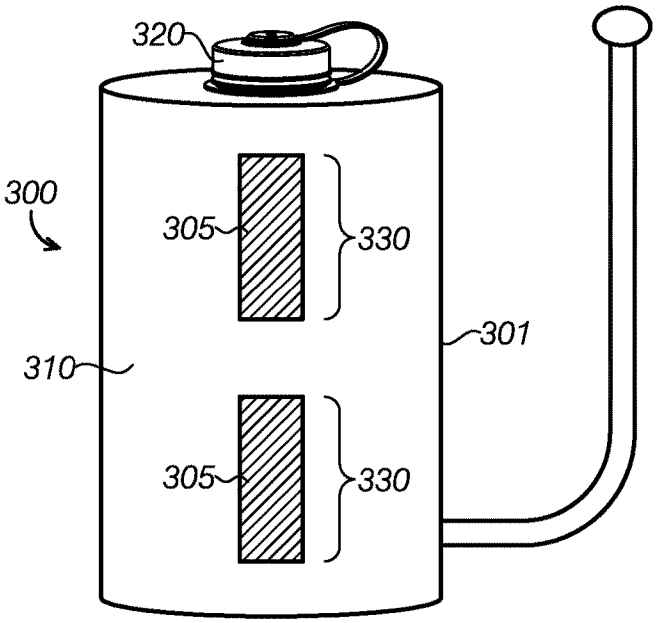
FIG. 6 shows a front perspective view of a third preferred embodiment of a reservoir.

While the preferred swinging suppressing mechanisms discussed thus far comprise rigid mechanical connectors with geometric shapes that fit into correspondingly shaped connecting mechanisms in the hydration pack, the preferred swinging mechanisms are not limited to rigid connectors. FIG. 6 illustrates a front view a third preferred embodiment of a wearable fluid reservoir 300 with a swinging suppressing mechanism 305 comprising hook-and-loop fasteners (e.g., VELCRO®) formed on an outer surface 310 of the reservoir main body 301. In the illustrated embodiment in FIG. 6, the fasteners 305 are located in two vertically spaced groups or patches 330. The third preferred reservoir 300 is configured to be fit securely within an alternative embodiment of a hydration pack 1300 shown in FIG. 7 comprising a compatible connecting mechanism 1310. The pack 1300 comprises two vertically spaced apart patches 1330 of hook-and-loop fasteners 1310 that are aligned and configured to mate with the patches 330 of hook-and-loop fasteners 310 on the reservoir 300 in FIG. 6.

Figure 9:
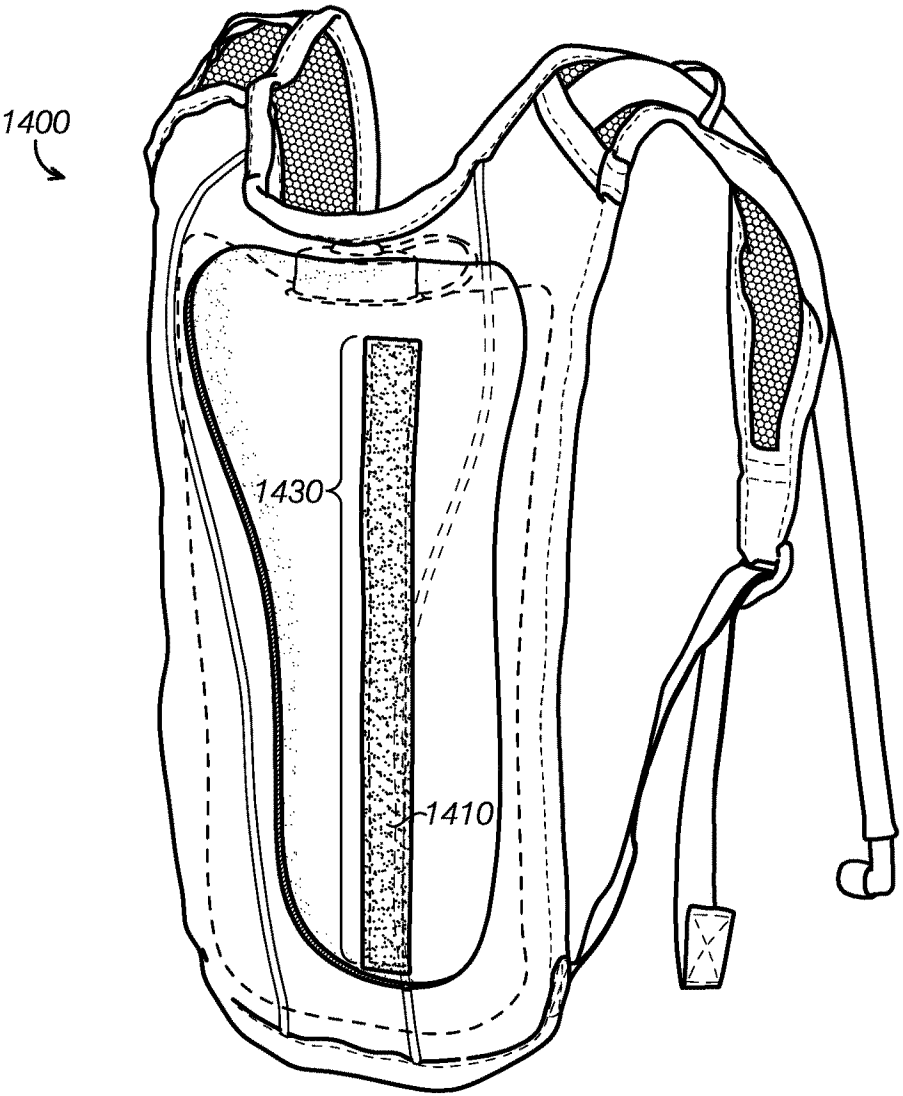
FIG. 9 shows a rear partial cutaway view of an alternative embodiment of a hydration backpack configured to hold the fourth preferred reservoir.
Figure 8:
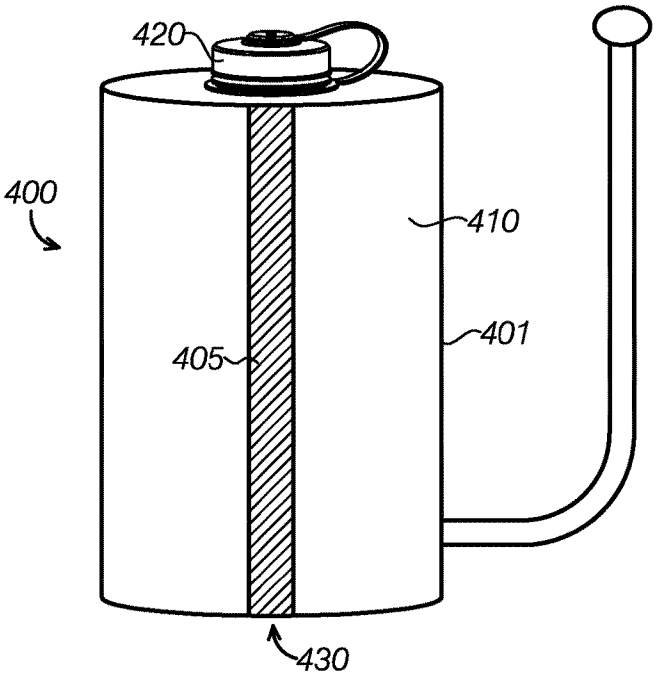
FIG. 8 shows a front perspective view of a fourth preferred embodiment of a reservoir.

FIG. 8 illustrates a fourth preferred embodiment of a reservoir 400 that includes a swinging suppressing mechanism 405 comprising an elongated vertical strip of hook-and-loop fasteners 405 formed on an outer surface 410 of the reservoir main body 401. The vertically extending arrangement 430 of hook-and-loop fasteners 405 preferably extends from top to bottom of the reservoir main body 401. The fourth preferred reservoir 400 is configured to be fit securely within an alternative embodiment of a hydration pack 1400 shown in FIG. 9 having a compatible connecting mechanism 1410. The pack 1400 comprises a vertically elongated patch 1430 of hook-and-loop fasteners 1410 aligned and configured to mate with the vertically elongate patch 430 of hook-and-loop fasteners 410 on the reservoir 400 in FIG. 8.

Figure 10:
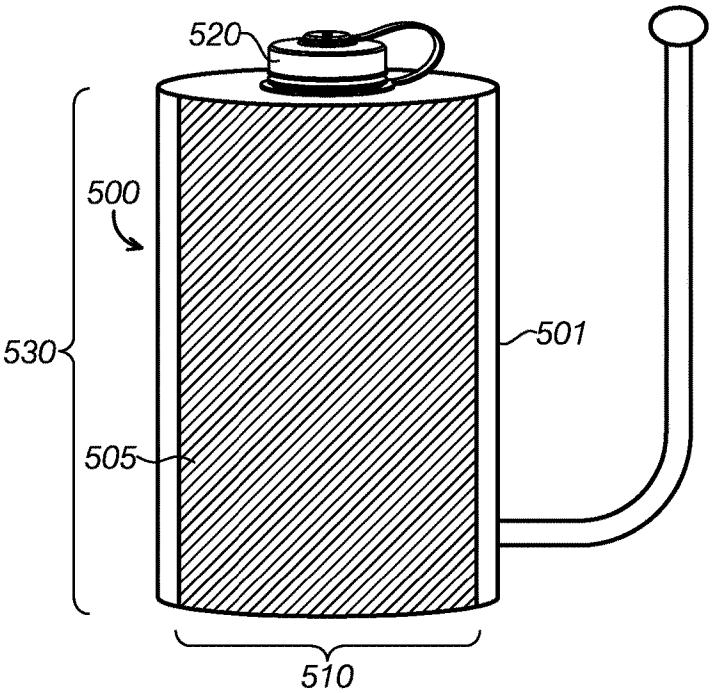
FIG. 10 shows a front perspective view of a fifth preferred embodiment of a reservoir.

FIG. 10 illustrates a fifth preferred embodiment of a reservoir 500 with a swinging suppressing mechanism 505 comprising a panel 530 of hook-and-loop fasteners covering one-third to one-half of the surface area of the outer surface of the reservoir main body 501. Thus, the swinging suppressing mechanism 505 substantially covers an entire side or portion of the outer surface 510 facing the user. The fifth preferred reservoir 500 is configured to be fit securely within an alternative embodiment of a hydration pack 1500 shown in FIG. 11 having a compatible connecting mechanism 1510 to removably secure the fasteners 510 of the reservoir 500. The pack 1500 comprises a planar patch 1530 of hook-and-loop fasteners 1510 that substantially covers the panel 530 of hook-and-loop fasteners 510 on the reservoir 500 in FIG. 10.

Figure 11:
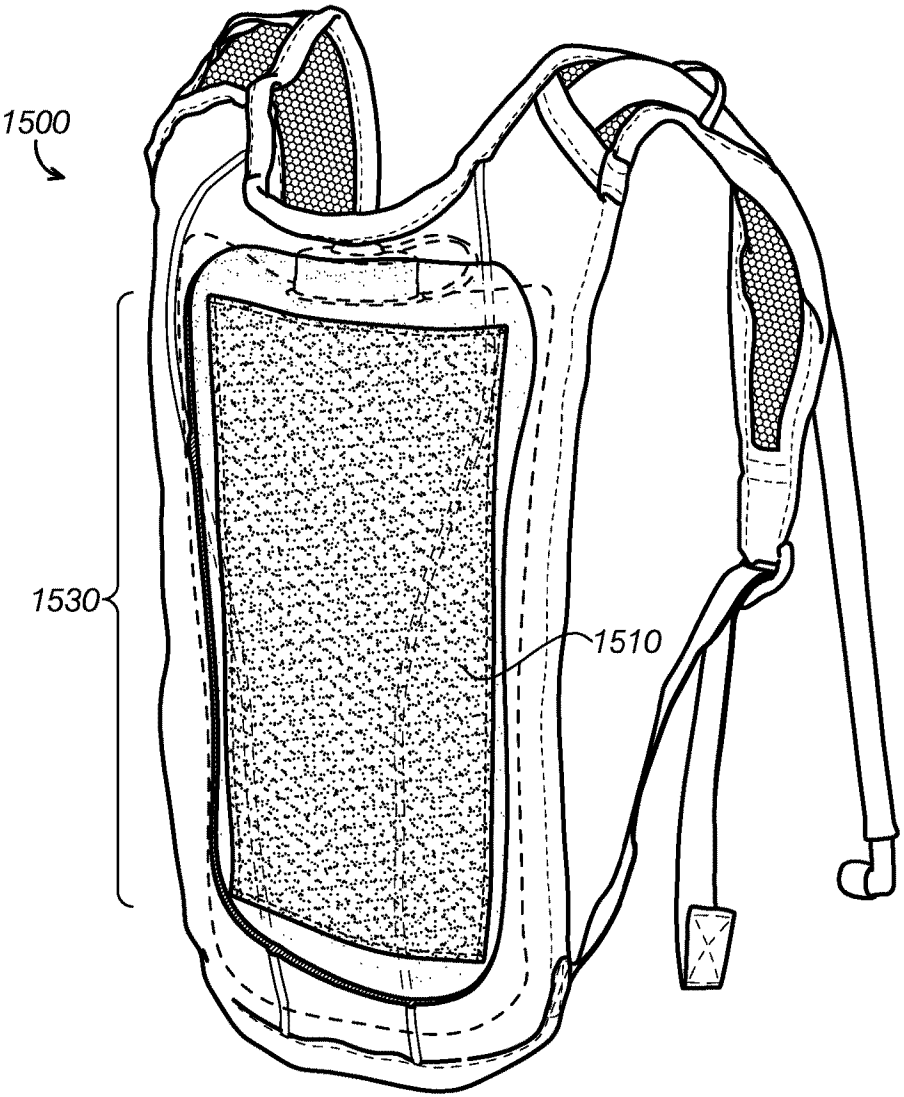
FIG. 11 shows a rear partial cutaway view of an alternative embodiment of a hydration backpack configured to hold the fifth preferred reservoir.

It will be appreciated that any of the foregoing preferred embodiments of the reservoir comprising any arrangement of hook-and-loop fasteners, including the preferred reservoirs of FIGS. 6 and 8, may be used with the preferred pack 1500 in FIG. 11 comprising hook-and-loop fasteners that substantially cover a vertical inner surface thereof.

Figure 13:
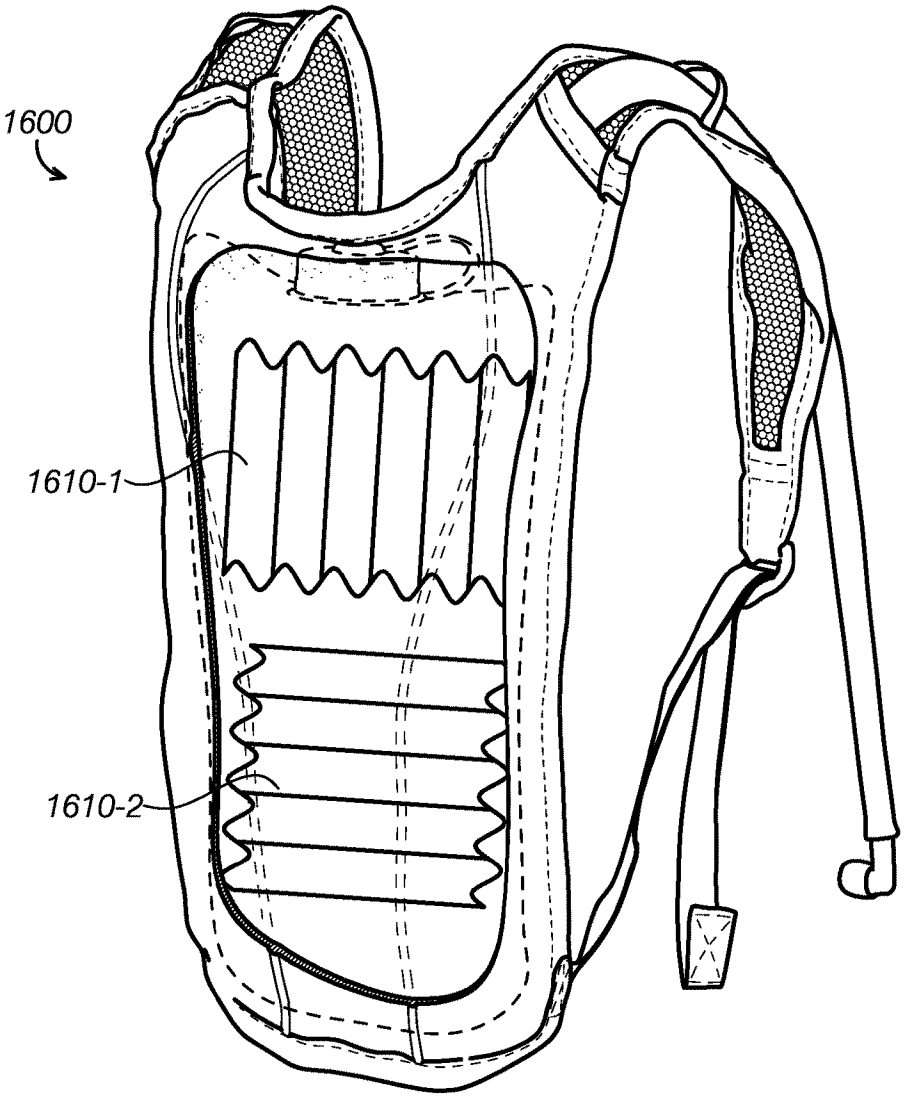
FIG. 13 shows a rear partial cutaway view of an alternative embodiment of a hydration backpack configured to hold the sixth preferred reservoir.
Figure 12:
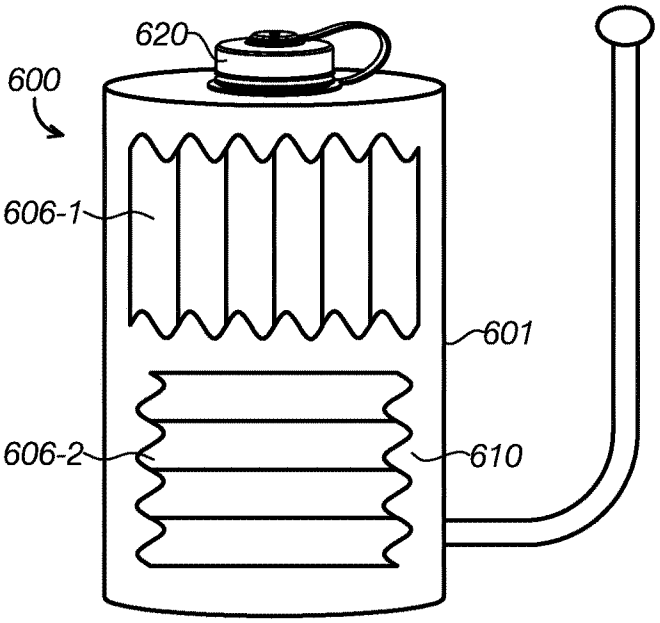
FIG. 12 shows a front perspective view of a sixth preferred embodiment of a reservoir.

FIG. 12 shows a front view of a sixth preferred embodiment of a reservoir 600 with a swinging suppressing mechanism 606 comprising corrugated portions 606-1, 606-2 of the outer surface 610 of the reservoir main body 601, which mate with a compatible connecting mechanism 1610-1, 1610-2 formed in an alternative embodiment of a pack 1600 shown in FIG. 13. The first corrugated portion 606-1 comprises vertically extending waves of alternating convex and concave surfaces that collectively inhibit horizontal swinging when mated with the first corrugated section 1610-1 in the pack 1600 in FIG. 13. The second corrugated portion 606-2 comprises horizontally extending waves that inhibit vertical swinging when mated with similarly oriented waves 1610-2 formed in the pack 1600 in FIG. 13.

Any swinging or loose movements of the reservoir 600 in relation to the pack 1600 are inhibited by the occlusal patterns of the corrugated portions 606-1, 606-2. The corrugated sheets 606 can be integrally molded with the reservoir 600.

Figure 14:
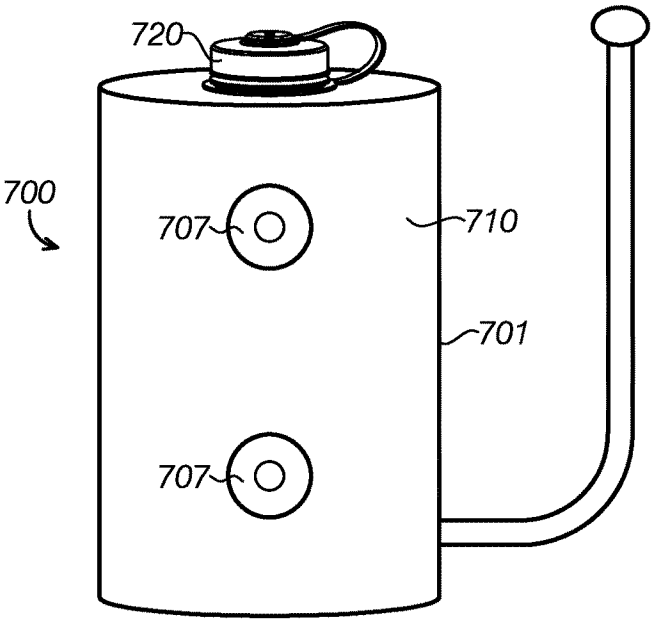
FIG. 14 shows a front perspective view of a seventh preferred embodiment of a reservoir.

FIG. 14 illustrates a front view of a seventh preferred embodiment of a reservoir 700 including a swinging suppressing mechanism 707 comprising one or more suction cups. The suction cups 707 are placed on an outer surface 710 of the reservoir main body 701. In the illustrated embodiment, the suction cups 707 are placed in two vertically spaced apart locations, though the swinging suppressing mechanism 707 may comprise more suction cups arranged at different locations. Each suction cup 707 may be integrally formed with the reservoir main body 701.

Figure 15:
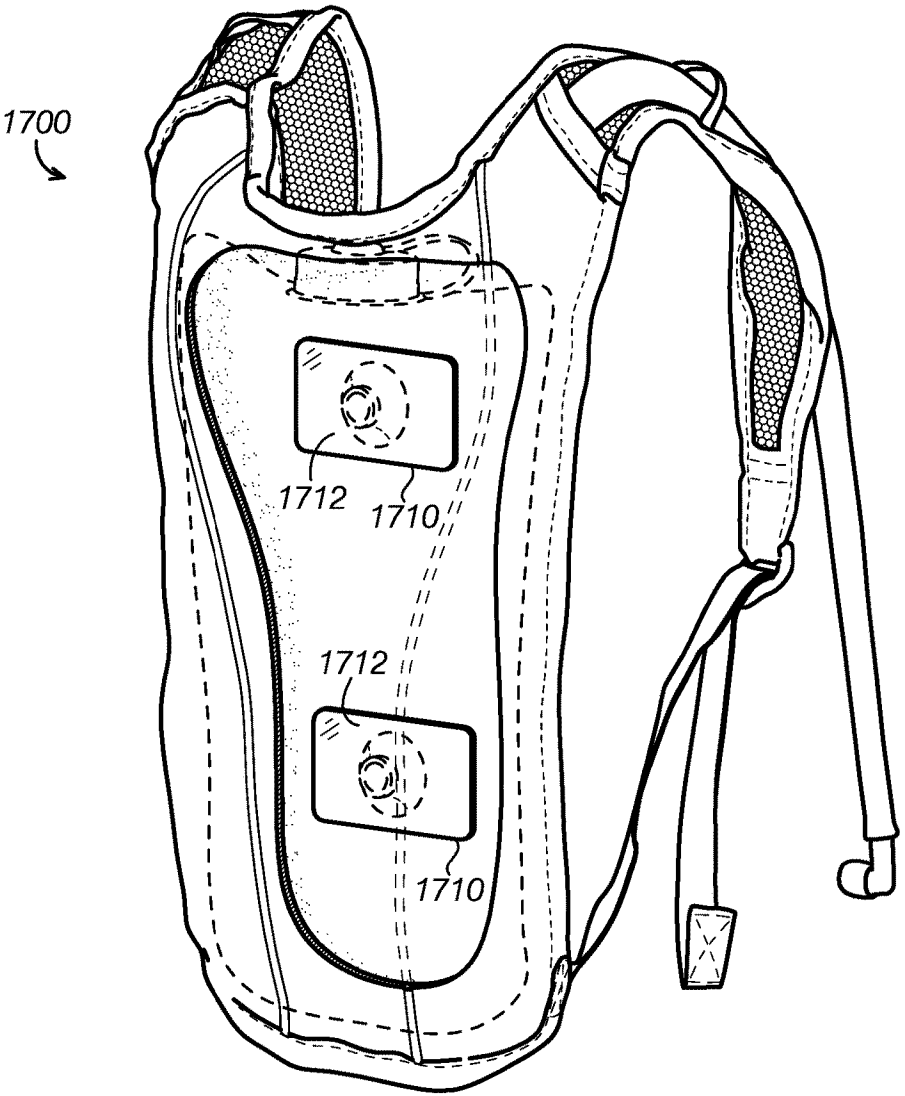
FIG. 15 shows a rear partial cutaway view of an alternative embodiment of a hydration backpack configured to hold the seventh preferred reservoir.

The reservoir 700 is inserted within and removably secured to an alternative embodiment of a pack 1700 including a compatible connecting mechanism 1710 as shown in FIG. 15. The connecting mechanism 1710 comprises a pair of plates 1710 with substantially smooth and flat surfaces 1712 onto which the suction cups 707 may adhere. The number and position of plates 1710 in the pack 1700 correspond to the number and position of the suction cups 707 in the reservoir 700.

Figure 17:
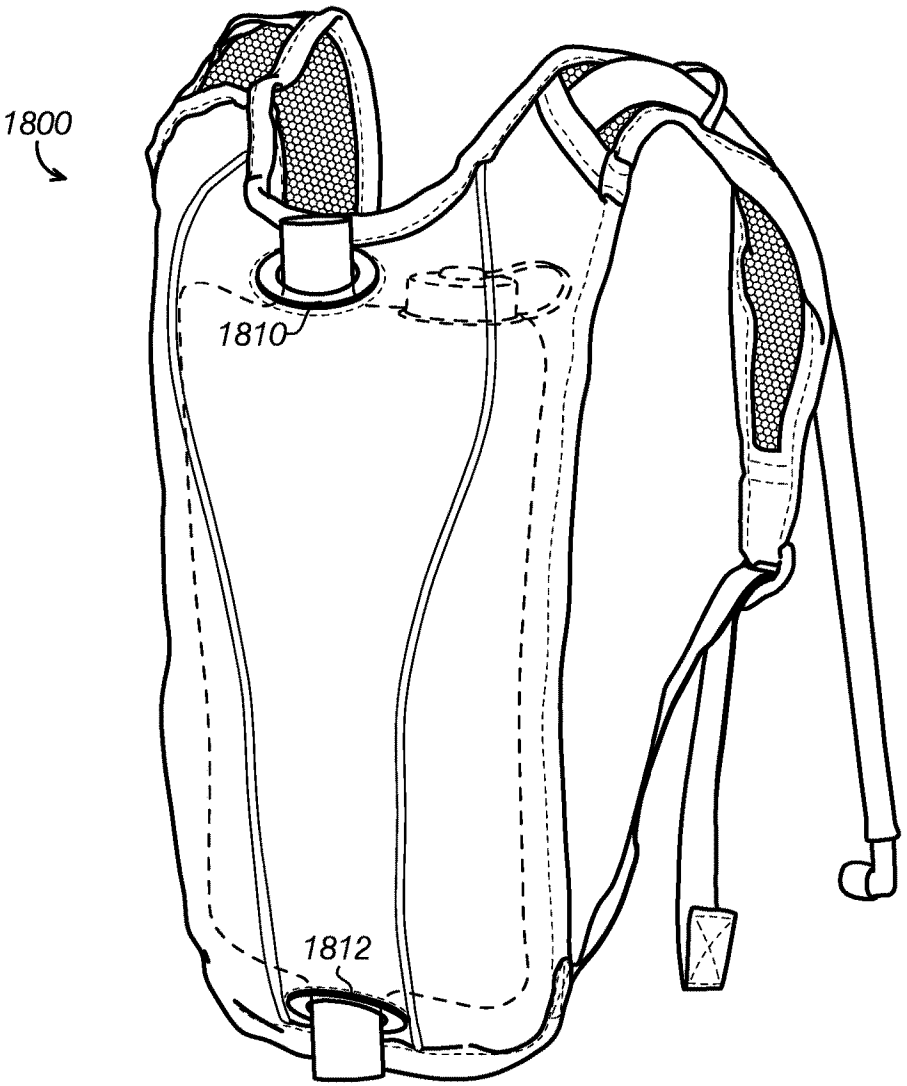
FIG. 17 shows a rear perspective view of an alternative embodiment of a hydration backpack configured to hold the eighth preferred embodiment of the reservoir.
Figure 16:
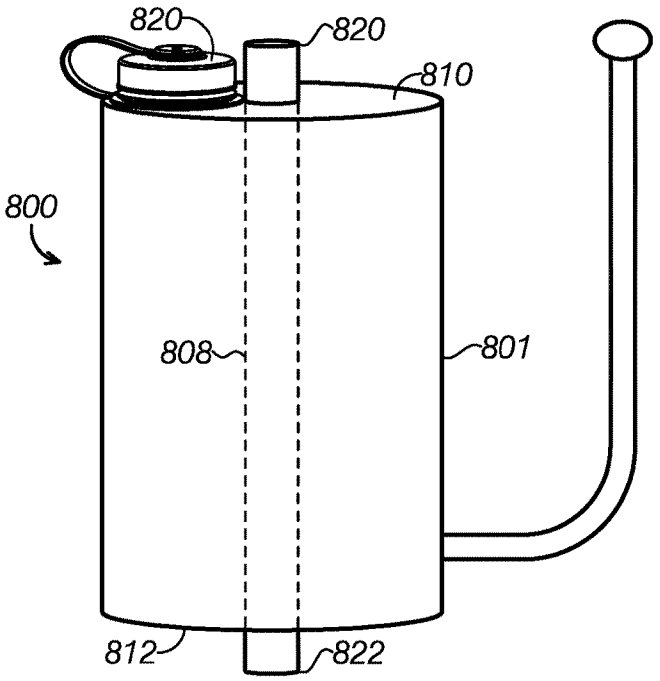
FIG. 16 shows a front perspective view of an eighth preferred embodiment of a reservoir.

FIG. 16 illustrates a front view of an eighth preferred embodiment of a reservoir 800 that employs a swinging suppressing mechanism 808 comprising a vertical strut 808. The strut 808 vertically penetrates through the reservoir main body 801 protruding out from the top 810 and bottom 812. FIG. 17 illustrates an alternative embodiment of a pack 1800 with a connecting mechanism 1810, 1812 comprising a top opening 1810 and a bottom opening 1812 configured to receive the protruding top strut portion 820 and bottom strut portion 822, respectively. In the preferred embodiment, the strut 808 may be integrally molded or otherwise formed with the reservoir main unit 801.

Figure 18:
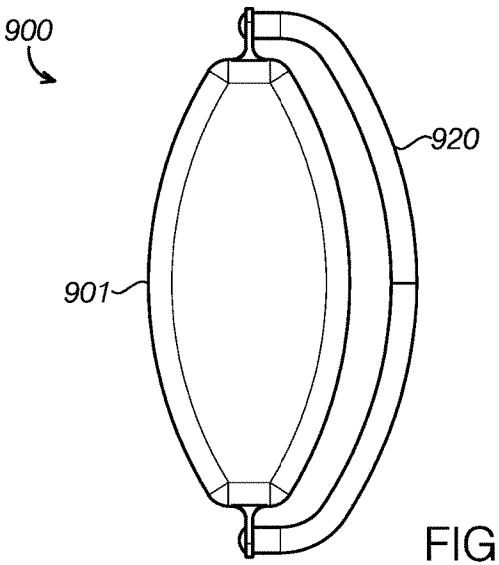
FIG. 18 is a side elevation view of a ninth preferred embodiment of a reservoir including structural reinforcements.
Figure 19:
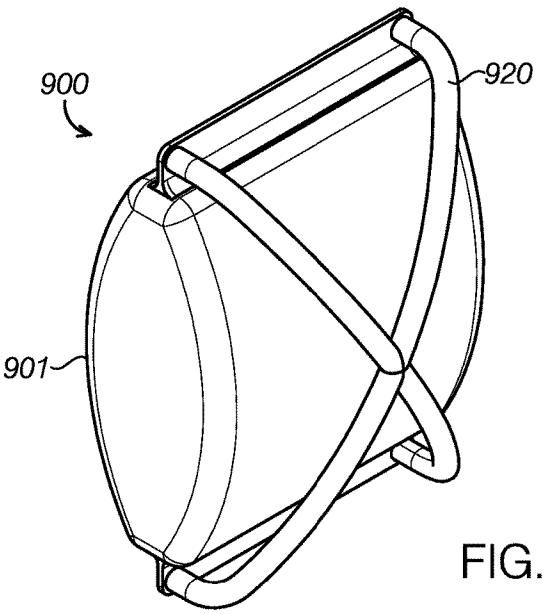
FIG. 19 is a front perspective view of the ninth preferred embodiment of the reservoir with the structural reinforcements.

FIGS. 18 and 19 show a ninth preferred embodiment of a reservoir 900 including structural reinforcements 920 configured in a crisscross manner across a vertical wall 930 of the reservoir main body. The structural braces 920 help maintain the shape of the reservoir body 901 and shield the reservoir 900 from impact as the reinforcement members 920 face the back of the user. The reinforcing structural members 920 help maintain the shape of the main body of the reservoir, particularly when the main body of the reservoir comprises a flexible bag that is not conducive to holding a fixed shape while the amount of the liquid contained therein decreases. Therefore, a reinforcing member is attached in order to maintain the shape of the main body of the reservoir regardless of the remaining amount of the liquid content.

Figure 20:
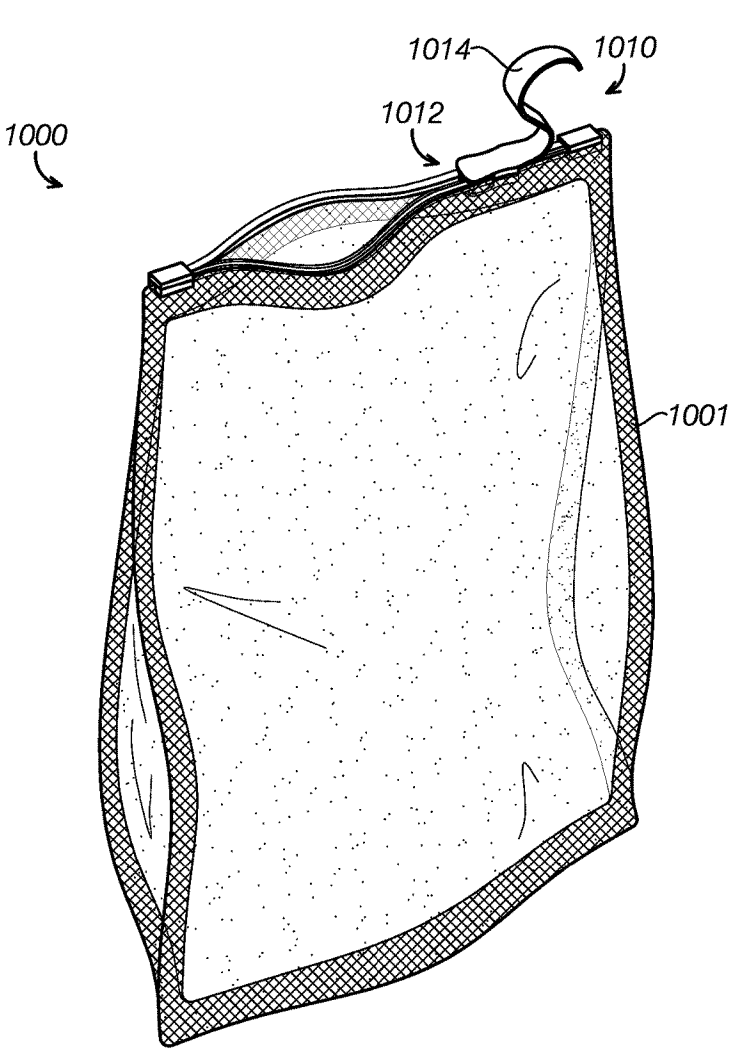
FIG. 20 is a perspective view of a tenth preferred embodiment of a reservoir with a swinging suppressing mechanism that also comprises a closure mechanism.

FIG. 20 is a perspective view of a tenth preferred embodiment of a reservoir 1000 with a swinging suppressing mechanism 1010 that also comprises a closure mechanism. In particular, the swinging suppressing mechanism 1010 comprise a zipper 1012 configured to open and seal a top portion of the reservoir main body 1001. The zipper latch further comprises a hook 1014 which can then be received into a clip or opening formed in a hydration backpack configured to hold the reservoir 1000 such as the alternative embodiment of a backpack 1200 shown in FIG. 5.

Figure 21:
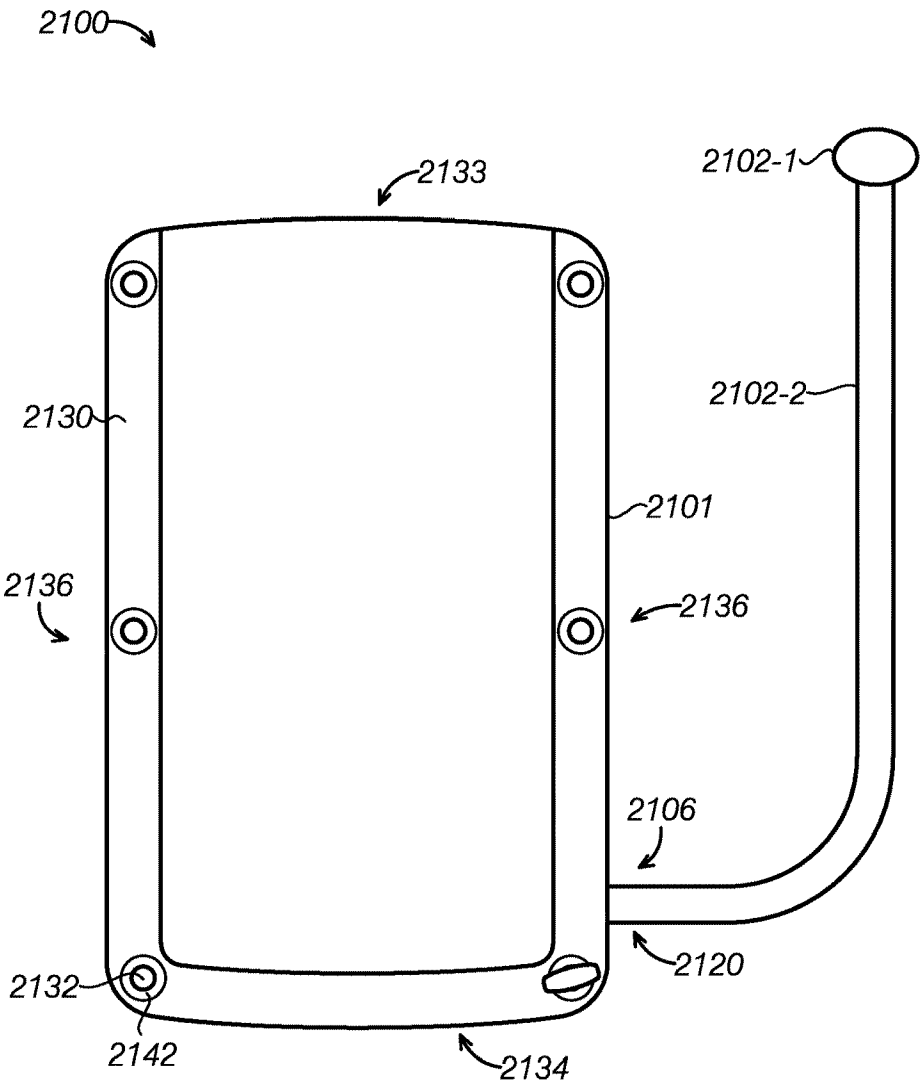
FIG. 21 is a front view of an eleventh preferred embodiment of a reservoir with eyelets.

FIG. 21 is front view of an eleventh preferred embodiment of a wearable fluid reservoir 2100 having an extended border 2130 containing eyelets 2132. The border 2130 is preferably formed along a bottom 2134 and both sides 2136 of the reservoir 2100 so as to form a U-shape. The border 2130 is substantially thin and planar. Unlike the hollow receptacle 2133 of the reservoir 2100, the thin border 2130 is preferably devoid of any space between the front and back sides except for the eyelets 2132.

The portable reservoir 2100 comprises a reservoir main body 2101 configured to hold liquids. One end portion 2120 of a sipping tube 2102-2 is coupled to a lower portion 2106 of the reservoir main body 2101 while an opposite tube portion 2122 is in fluid communication with a suction option 2102-1. A user can drink liquid from the suction opening 2102-1.

Figure 22:
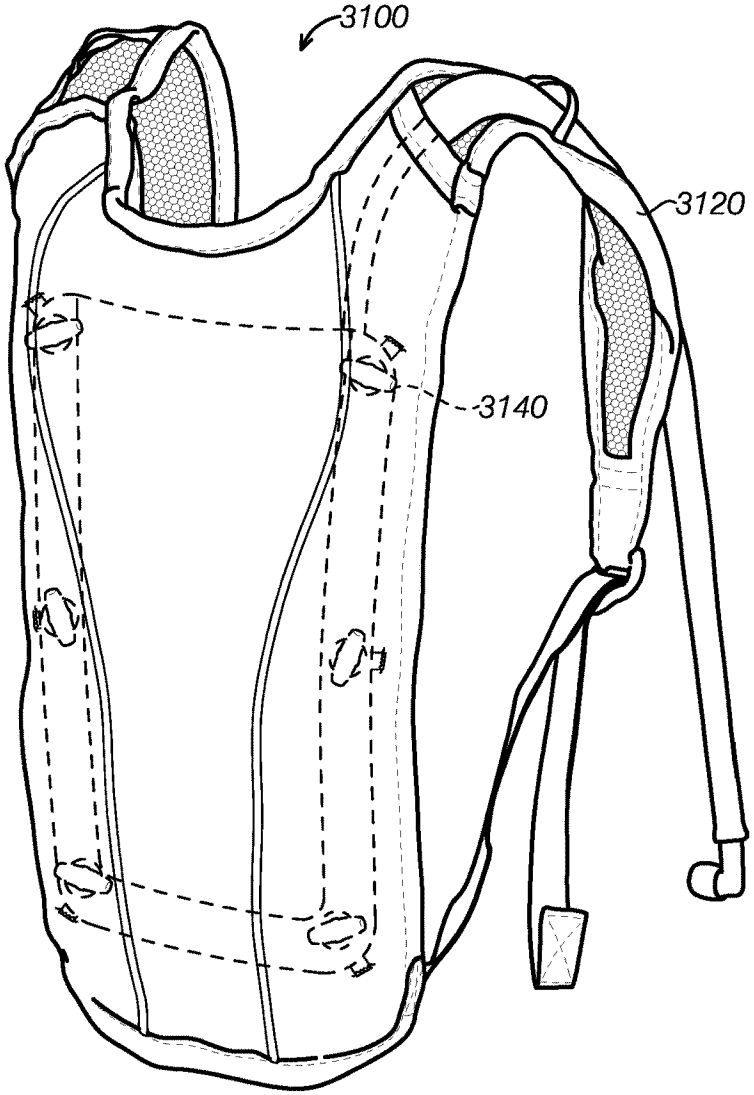
FIG. 22 is a rear perspective view of an alternative embodiment of a hydration backpack configured to hold the eleventh preferred embodiment of the reservoir.

The reservoir 2100 includes a preferred swinging suppressing mechanism that inhibits swinging or loose movements of the reservoir 2100 in relation to a preferred embodiment of a hydration backpack, or simply pack, 3100 shown in FIG. 22, into which the reservoir 2100 is inserted. In the preferred embodiment shown in FIG. 21, the swinging suppressing mechanism comprises a substantially thin and planar border eyelets 2132, each preferably reinforced with a grommet 2142 and configured to receive a corresponding toggle 3140 as discussed below. When reservoir 2100 is coupled to the pack 3100, the reservoir main body 2101 is vertically and horizontally fixed to the preferred pack shown in FIG. 22.

In FIG. 22, the preferred backpack 3100 comprises a connecting mechanism configured to removably mate with the swinging suppressing mechanism 2103 of the reservoir 2100. The pack 3100 is configured to be worn on a user and comprises a pair of shoulder straps 3120. In this preferred embodiment, the connecting mechanism comprises a plurality of toggles 3140, where a particular toggle 3140 is configured to be inserted through a corresponding eyelet 2132 in FIG. 21. Thus, the eyelets 2132 are numbered and positioned in accordance with the number and positions of the toggles 3140. This prevents the reservoir main body 2101 from swinging or moving loosely within the backpack 3100, thereby reducing the burden on the user. In particular, the combination of the swinging suppressing mechanism of the reservoir 2100 removably coupled to the connecting mechanism of the pack 3100 inhibits both horizontal and vertical movement of the reservoir 2100 with respect to the pack 3100. The toggles 3140 may be easily detached from the eyelets 2132 to enable removal of the reservoir 2100 from the pack 3100.

In all of the foregoing preferred embodiments, the wearable fluid reservoir may be mounted adjacent to the contact side of the backpack that faces the user. In addition, a cushion member having a matching planar or three-dimensional shape may be also attached on the body-contacting side of the user, which makes it possible to ensure comfortable wearing of the reservoir by the user. Also, at least one mounting position may be deployed in the region of the mechanism which closes the port used to seal the liquid within the reservoir.

In all of the foregoing embodiments, the swinging suppressing mechanism is positioned along at least a top portion and a bottom portion of the reservoir in main body to inhibit vertical and horizontal swinging of the reservoir main body with respect to the pack to which the reservoir is attached. For example, in FIG. 1, the top button 103 is positioned at a top portion of the reservoir main body 101 while the bottom button 103 is positioned at the bottom portion of the reservoir main body 101. Similarly, in FIG. 4, the top and bottom hooks 204 are positioned at top and bottom portions of the reservoir main body, respectively. The hook-and-loop fasteners shown in FIGS. 6, 8 and 10 are positioned at least along top and bottom portions of the reservoir main body. The swinging suppressing mechanism in FIG. 12 comprises a top corrugated section 606-1 and a bottom corrugated section 606-2. The swinging suppressing mechanism in FIG. 14 comprises top and bottom suction cups 707. Lastly, the swinging suppressing mechanism in FIG. 16 comprises a strut that is positioned not only along top and bottom portions of the reservoir main body, but actually penetrates through the top and bottom ends of the reservoir main body.

Accordingly, the preferred packs in each of the preferred embodiments comprise compatible connecting mechanism that removably receive or mate with the top and bottom swinging suppressing mechanisms. Therefore, each connecting mechanism comprises at least the same number and positions of corresponding structures that mate with the swinging suppressing mechanisms of the reservoir.

The present invention is useful for reservoirs which are stored in a portable bag for carrying a liquid, as well as for hydration systems which are used to supply water during exercising movements.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A wearable fluid reservoir apparatus, comprising;

a reservoir main body comprising a U-shaped, flat border surrounding only a bottom and opposite sides of the reservoir main body without extending across a top side thereof;

a plurality of openings formed through the border at a plurality of locations about the border, the plurality of locations including at least one opening at the bottom and at least one opening at each of the opposite sides; and a connecting mechanism configured to be coupled to the border at the plurality of openings, wherein the connecting mechanism and the plurality of openings create a swinging suppressing mechanism to inhibit horizontal and vertical movements of the reservoir main body with respect to a pack.

2. The apparatus of claim 1, wherein the plurality of openings is positioned on the reservoir main body in at least a first location and a second location.

3. The apparatus of claim 1, wherein the plurality of openings includes eyelets.

4. The apparatus of claim 3, wherein the connecting mechanism comprises toggles removably coupled to the eyelets.

5. The apparatus of claim 1, wherein the reservoir main body comprises a soft material.

6. A wearable fluid reservoir apparatus, comprising:

a reservoir main body comprising a border surrounding only a bottom and opposite sides of the reservoir main body without extending across a top side thereof;

a plurality of openings formed through the border at a plurality of locations about the border, the plurality of locations including at least one opening at the bottom and at least one opening at each of the opposite sides;

a pack configured to receive the reservoir main body therein, the pack comprising a connecting mechanism configured to be coupled to the border at the plurality of openings, wherein the connecting mechanism and the plurality of openings create a swinging suppressing mechanism to inhibit horizontal and vertical movements of the reservoir main body with respect to a pack.

7. The apparatus of claim 6, wherein the plurality of openings is positioned on the reservoir main body in at least a first location and a second location.

8. The apparatus of claim 6, wherein the plurality of openings includes eyelets.

9. The apparatus of claim 8, wherein the connecting mechanism comprises toggles removably coupled to the eyelets.

10. The apparatus of claim 6, wherein the reservoir main body comprises a soft material.

11. A wearable fluid reservoir apparatus, comprising:

a pack comprising a connecting mechanism including a toggle; and a reservoir housed within the pack and comprising a reservoir main body including U-shaped, flat a border, the border, extending only along a bottom side and opposite sides of the reservoir main body without extending across a top side thereof, comprising eyelets configured to removably receive the toggle to inhibit horizontal and vertical movements of the reservoir main body with respect to the pack, the eyelets being positioned in at least one location at a bottom border of the reservoir and at least one location at each of the opposite sides of the reservoir.

12. The apparatus of claim 11, wherein the reservoir main body comprises a soft material.

13. The apparatus of claim 1, wherein the least one opening at each of the opposite sides includes a upper opening at an upper end of each of the opposite sides, a lower opening at a lower end of each of the opposite sides, and a central opening, between the upper opening and the lower opening, at each of the opposite sides.

14. The apparatus of claim 6, wherein the least one opening at each of the opposite sides includes a upper opening at an upper end of each of the opposite sides, a lower opening at a lower end of each of the opposite sides, and a central opening, between the upper opening and the lower opening, at each of the opposite sides.

15. The apparatus of claim 11, wherein the least one opening at each of the opposite sides includes a upper opening at an upper end of each of the opposite sides, a lower opening at a lower end of each of the opposite sides, and a central opening, between the upper opening and the lower opening, at each of the opposite sides.

* * * * *